US011482150B2

(12) United States Patent
Kim et al.

(10) Patent No.: US 11,482,150 B2
(45) Date of Patent: Oct. 25, 2022

(54) DEVICE AND METHOD FOR DRIVING DISPLAY SUPPORTING LOW POWER MODE

(71) Applicant: SILICON WORKS CO., LTD., Daejeon (KR)

(72) Inventors: Byeong Yong Kim, Daejeon (KR); Chang Bae Lee, Daejeon (KR); Se Jin Choi, Daejeon (KR)

(73) Assignee: SILICON WORKS CO., LTD., Daejeon (KR)

( * ) Notice: Subject to any disclaimer, the term of this patent is extended or adjusted under 35 U.S.C. 154(b) by 0 days.

(21) Appl. No.: 17/242,637

(22) Filed: Apr. 28, 2021

(65) Prior Publication Data

US 2021/0350735 A1 Nov. 11, 2021

(30) Foreign Application Priority Data

May 8, 2020 (KR) ..... 10-2020-0054902

(51) Int. Cl.
*G09G 3/36* (2006.01)
*G09G 3/20* (2006.01)

(52) U.S. Cl.
CPC ..... *G09G 3/20* (2013.01); *G09G 2310/0251* (2013.01); *G09G 2310/08* (2013.01); *G09G 2330/021* (2013.01)

(58) Field of Classification Search
CPC ..... G09G 3/20; G09G 3/32; G09G 3/2074; G09G 2310/0251; G09G 2310/08; G09G 2310/027; G09G 2310/0297; G09G 2310/0286; G09G 2330/021; G09G 2330/023; G09G 2330/028; G09G 2320/0673; G09G 2320/0247; G06F 3/0412
USPC ..... 345/98
See application file for complete search history.

(56) References Cited

U.S. PATENT DOCUMENTS 7,091,946 B2 * 8/2006 Tsutsui ..... G09G 3/3648 345/100
7,372,445 B2 * 5/2008 Takahashi ..... G09G 3/3688 345/100
2007/0063959 A1 * 3/2007 Iwabuchi ..... G09G 3/3688 345/100

(Continued)

FOREIGN PATENT DOCUMENTS

KR 10-2012-0002069 A 1/2012

*Primary Examiner* — Jennifer T Nguyen
(74) *Attorney, Agent, or Firm* — Harness, Dickey & Pierce, P.L.C.

(57) ABSTRACT

A display driving device supporting a low power mode according to an aspect of the present disclosure that is capable of minimizing power consumption when driving in the low power mode includes a plurality of output buffers connected to data lines to precharge the data lines with a first data signal corresponding to a black image when a precharge horizontal line is driven in a display panel including a first region where a standby image is displayed and the second region where the black image is displayed, the precharge horizontal line being included in the second region, and a gamma voltage generator connected to the data lines to output the first data signal to the data lines when other horizontal lines other than the precharge horizontal line in the second region are driven.

18 Claims, 10 Drawing Sheets

(56) References Cited

U.S. PATENT DOCUMENTS

2008/0303771 A1* 12/2008 Chen ..... G09G 3/3688
345/94
2012/0001950 A1* 1/2012 Kim ..... G09G 3/3291
345/690

* cited by examiner

DEVICE AND METHOD FOR DRIVING DISPLAY SUPPORTING LOW POWER MODE

CROSS-REFERENCE TO RELATED APPLICATIONS

This application claims the benefit of the Korean Patent Application No. 10-2020-0054902 filed on May 8, 2020, which is hereby incorporated by reference as if fully set forth herein.

FIELD

The present disclosure relates to a display device, and more particularly, to a display driving device and a display driving method.

BACKGROUND

With the advancement of the information society, requirements for a display device for displaying an image are increasing in various forms. According to such requirements, various types of display devices such as an organic light emitting display device (OLED), and the like as well as a conventional liquid crystal display device (LCD) are being used.

The display devices described above are also applied to mobile terminals such as a mobile phone, a smartphone, a tablet computer, a laptop computer, and a wearable device. As shown in FIG. 1, a recently developed mobile terminal supports a low power mode that always displays a standby image 110 such as a clock, weather, or calendar designated by a user on a display device 100 when the mobile terminal is not in use, for example, an always on display (AoD) mode.

When the mobile device operates in the low power mode, the display device 100 is divided into a first region 120 where a black image is displayed and a second region 130 where the standby image 110 is displayed to reduce power consumption.

At this time, an output buffer (not shown) of each of source channels in the first region 120 where the black image is displayed is not turned off and maintains a turned-on state in order to represent a black voltage corresponding to a black gradation. However, even though the output buffer of each of the source channels outputs the black voltage, power is continuously consumed, and thus there is a problem that there is a limit to reduction of power consumption in the low power mode.

SUMMARY

An aspect of the present disclosure provides a display driving device and a display driving method supporting a low power mode, capable of minimizing power consumption when driving in the low power mode.

In addition, another aspect of the present disclosure provides a display driving device and a display driving method supporting a low power mode, capable of minimizing a color difference between the black represented in a first panel region and a second panel region when driving in the low power mode.

In addition, still another aspect of the present disclosure provides a display driving device and a display driving method supporting a low power mode, capable of reducing a panel load of a display device when driving in the low power mode.

In addition, yet another aspect of the present disclosure provides a display driving device and a display driving method supporting a low power mode, capable of minimizing leakage current occurred by a gamma voltage generator consecutively outputting a voltage corresponding to a black gradation when driving in the low power mode.

A display driving device supporting a low power mode according to an aspect of the present disclosure includes a plurality of output buffers connected to data lines to precharge the data lines with a first data signal corresponding to a black image when a precharge horizontal line is driven in a display panel including a first region where a standby image is displayed and the second region where the black image is displayed, the precharge horizontal line being included in the second region, and a gamma voltage generator connected to the data lines to output the first data signal to each of the data lines when other horizontal lines other than the precharge horizontal line in the second region are driven.

A display driving method supporting a low power mode according to another aspect of the present disclosure includes connecting a plurality of output buffers to each of data lines when driving a first region in which a standby image is displayed in a display panel and supplying a data signal of the standby image to the data line, connecting the plurality of output buffers to the data lines when driving a precharge horizontal line included in a second region where a black image is displayed and precharging the data lines with a data signal corresponding to the black image, and connecting a gamma voltage generator to the data lines when driving other horizontal lines other than the precharge horizontal line in the second region and outputting the data signal corresponding to the black image to the data lines.

BRIEF DESCRIPTION OF THE DRAWINGS

The accompanying drawings, which are included to provide a further understanding of the disclosure and are incorporated in and constitute a part of this application, illustrate embodiments of the disclosure and together with the description serve to explain the principle of the disclosure. In the drawings.

DETAILED DESCRIPTION

Figure 1:
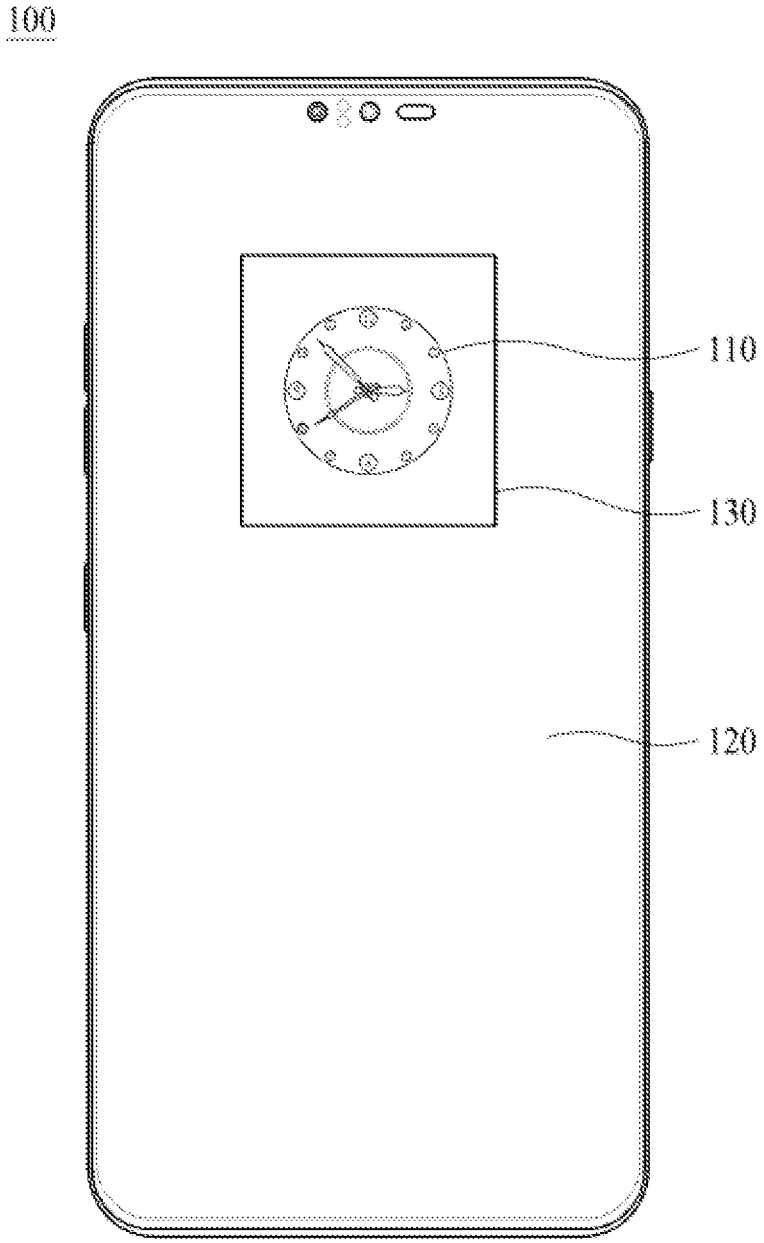
FIG. 1 PRIOR ART
FIG. 1 is a diagram illustrating a display device driven in a low power mode according to the related art.

In the specification, it should be noted that like reference numerals already used to denote like elements in other drawings are used for elements wherever possible. In the following description, when a function and a configuration known to those skilled in the art are irrelevant to the essential configuration of the present disclosure, their detailed descriptions will be omitted. The terms described in the specification should be understood as follows.

Advantages and features of the present disclosure, and implementation methods thereof will be clarified through following embodiments described with reference to the accompanying drawings. The present disclosure may, however, be embodied in different forms and should not be construed as limited to the embodiments set forth herein. Rather, these embodiments are provided so that this disclosure will be thorough and complete, and will fully convey the scope of the present disclosure to those skilled in the art. Further, the present disclosure is only defined by scopes of claims.

A shape, a size, a ratio, an angle, and a number disclosed in the drawings for describing embodiments of the present disclosure are merely an example, and thus, the present disclosure is not limited to the illustrated details. Like reference numerals refer to like elements throughout. In the following description, when the detailed description of the relevant known function or configuration is determined to unnecessarily obscure the important point of the present disclosure, the detailed description will be omitted.

In a case where 'comprise', 'have', and 'include' described in the present specification are used, another part may be added unless 'only~' is used. The terms of a singular form may include plural forms unless referred to the contrary.

In construing an element, the element is construed as including an error range although there is no explicit description.

In describing a time relationship, for example, when the temporal order is described as 'after~', 'subsequent~', 'next~', and 'before~', a case which is not continuous may be included unless 'just' or 'direct' is used.

It will be understood that, although the terms "first", "second", etc. may be used herein to describe various elements, these elements should not be limited by these terms. These terms are only used to distinguish one element from another. For example, a first element could be termed a second element, and, similarly, a second element could be termed a first element, without departing from the scope of the present disclosure.

The term "at least one" should be understood as including any and all combinations of one or more of the associated listed items. For example, the meaning of "at least one of a first item, a second item, and a third item" denotes the combination of all items proposed from two or more of the first item, the second item, and the third item as well as the first item, the second item, or the third item.

Features of various embodiments of the present disclosure may be partially or overall coupled to or combined with each other, and may be variously inter-operated with each other and driven technically as those skilled in the art can sufficiently understand. The embodiments of the present disclosure may be carried out independently from each other, or may be carried out together in co-dependent relationship.

Hereinafter, embodiments of this specification will be described in detail with reference to the accompanying drawings.

Figure 2:
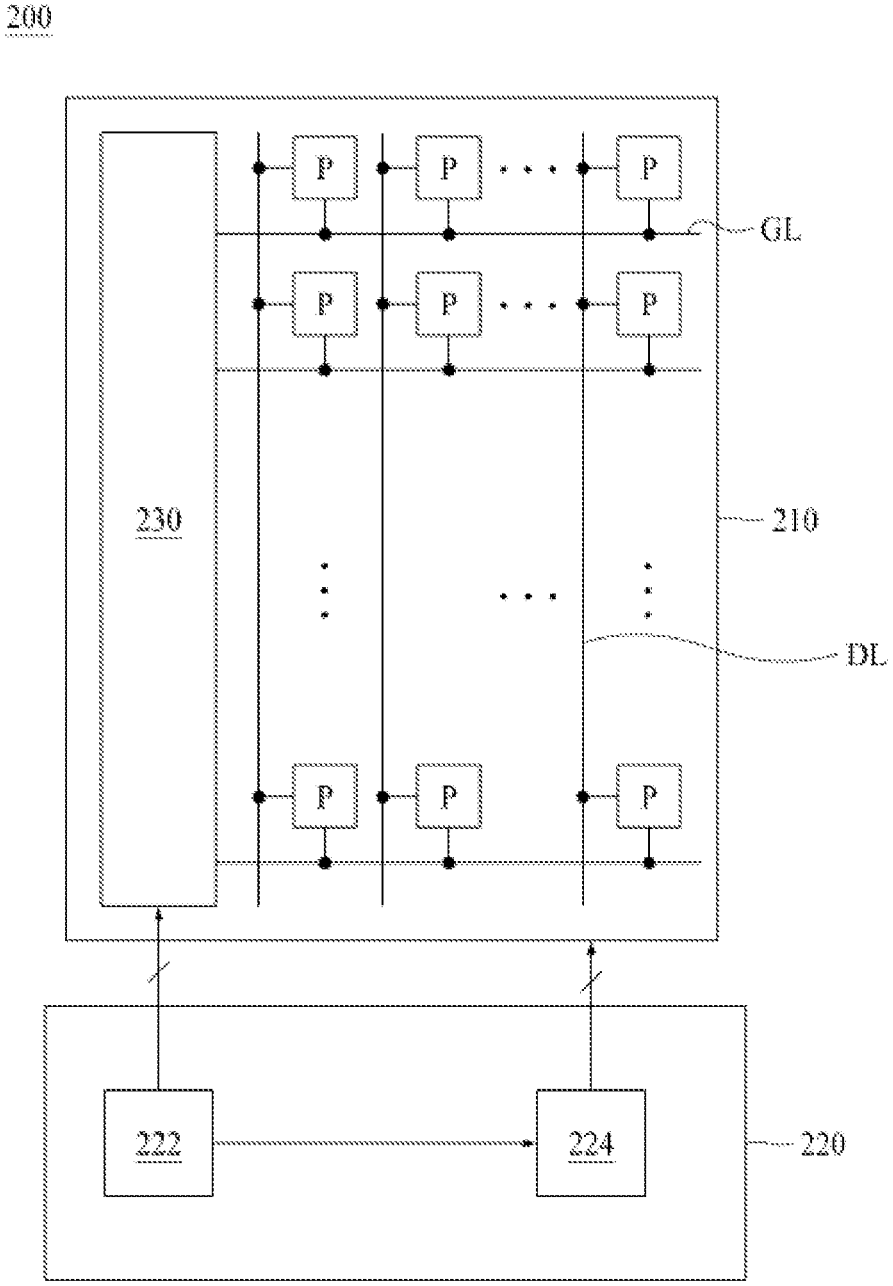
FIG. 2 is a diagram illustrating a configuration of a display system to which a display driving device supporting a low power mode according to an embodiment of the present disclosure is applied.
Figure 3A:
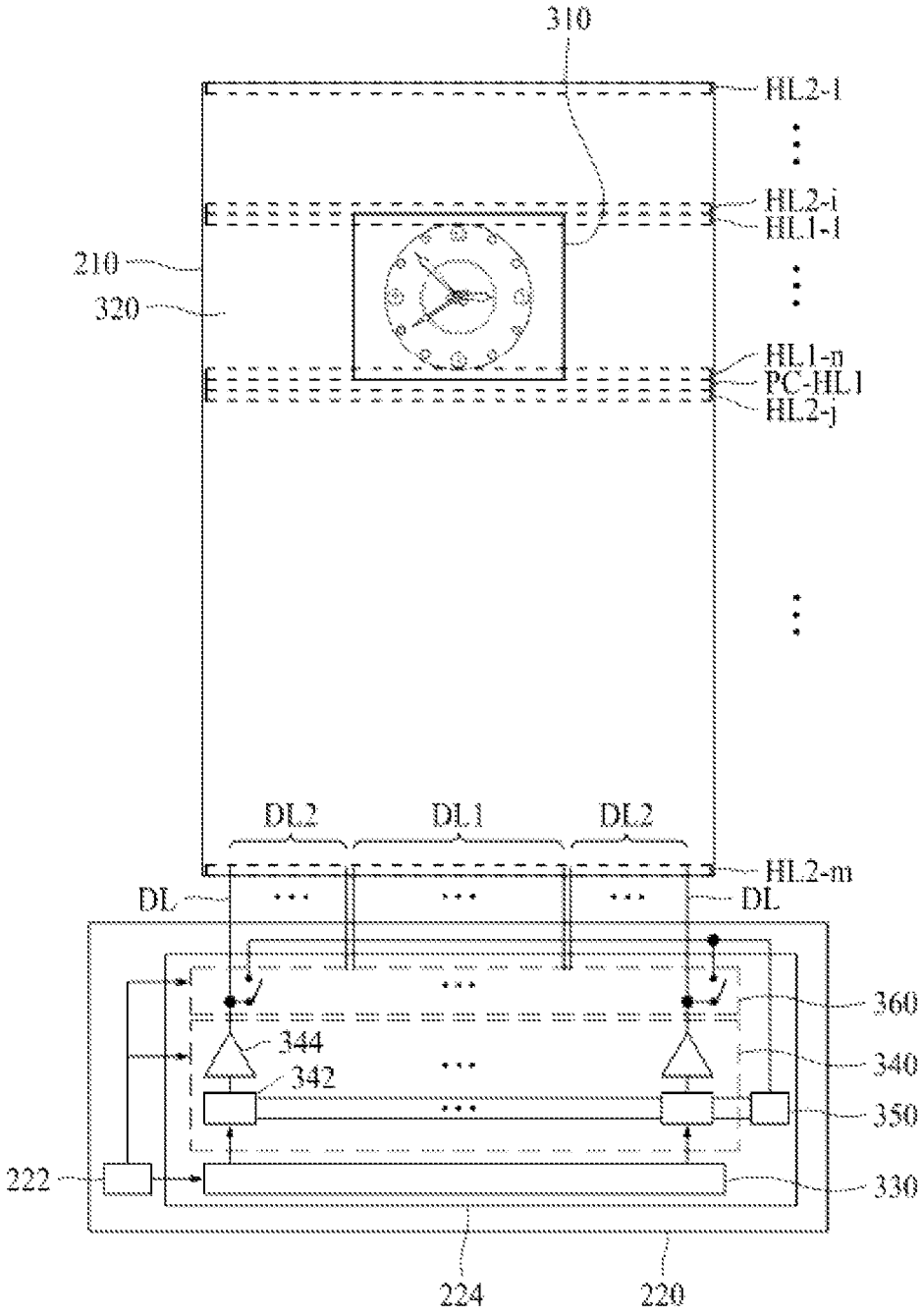
FIG. 3A is a diagram illustrating a specific configuration of the display driving device according to an embodiment of the present disclosure.

FIG. 2 and FIG. 3A are diagrams illustrating a configuration of a display system to which a display driving device supporting a low power mode according to an embodiment of the present disclosure is applied. Referring to FIG. 2 and FIG. 3A, a display system 200 according to the present disclosure includes a display panel 210 and a display driving device 220 for driving the display panel 210.

The display panel 210 includes data lines DL, gate lines GL crossing the data lines DL, and pixels P defined by the data lines DL and the gate lines GL. The pixels P are disposed in a matrix form.

The data lines DL supply a data signal input from the display driving device 220 to the pixels P. The gate lines GL supply a gate signal input from a gate driver 230 to the pixels P. Each of the pixels P may include sub-pixels (not shown) having different colors for color implementation. The sub-pixels may include red, green, and blue sub-pixels. In addition, each of the pixels P may further include a white sub-pixel.

In one embodiment, the display panel 210 according to the present disclosure may be an organic light emitting diode (OLED) display panel. In this case, each pixel P may include an organic light emitting diode (OLED), a driving transistor DT, at least one switching transistor, and at least one capacitor. The driving transistor DT controls an amount of current flowing through the organic light emitting diode (OLED). At least one switching transistor controls an operation of the driving transistor DT. In another embodiment, the display panel 210 according to the present disclosure may be a liquid crystal display (LCD) panel.

Meanwhile, the gate driver 230 may be formed on the display panel 210 according to the present disclosure. The gate driver 230 includes a shift register that outputs a gate pulse synchronized with the data signal in response to a gate timing control signal input through the display driving device 220.

The gate timing control signal includes a start pulse and a shift clock. The shift register sequentially supplies the gate pulse to the gate lines GL by shifting the start pulse according to a timing of the shift clock.

The switching transistors included in each of the pixels P of the display panel 210 are turned on according to the gate pulse to select the data line DL of the display panel 210 to which a data signal of an input image is input. The shift register may be directly formed on a substrate of the display panel 210 in the same process together with a transistor array of a pixel array.

Meanwhile, in the low power mode (or standby mode) in which the display system 200 is inactivated, as shown in FIG. 3A, the display panel 210 according to the present disclosure displays a preset standby image in a first region 310 and displays a black image in a second region 320. The display panel 210 displays a normal image in the first region 310 and the second region 320 in a normal mode in which the display system 200 is activated.

In FIG. 3A, it is illustrated that a clock image is displayed as the standby image, but this is only an example, and the standby image may include a calendar image, a weather image, and the like. In another embodiment, the standby image may include an image preset by a user.

The display driving device 220 drives the display panel 210 in the normal mode and the low power mode, supplies the data signal of the normal image or the standby image to the data lines DL in the normal mode and the low power mode, and supplies the gate timing control signal including clock signals CLK to the gate driver 230.

To this end, the display driving device 220 includes a timing controller 222 and a data driver 224. The data driver 224 includes a digital processing unit 330, an analog processing unit 340, a gamma voltage generator 350, and a plurality of first switching units 360 as shown in FIG. 3A. FIG. 3A illustrates that the timing controller 222 is included in the display driving device 220, but this is only an example, and the timing controller 222 may be installed separately from the display driving device 220.

The timing controller 222 determines an operation mode of the display panel 210 as one of the normal mode and the low power mode and controls operations of the data driver 224 and the gate driver 230 according to the determined operation mode.

Specifically, when the display panel 210 operates in the normal mode, the timing controller 222 controls the operations of the data driver 224 and the gate driver 230 so that the data signal of the normal image input from a host system may be supplied to all the pixels P included in the display panel 210.

In addition, when the display panel 210 operates in the low power mode, the timing controller 222 controls the operations of the data driver 224 and the gate driver 230 so that a data signal ("Data_SB" in FIG. 3B) of a predetermined standby image may be supplied to the pixel P included in the first region 310 of the display panel 210 and a data signal ("00" in FIG. 3B) of the black image may be supplied to the pixel P included in the second region 320.

In particular, when the display panel 210 operates in the low power mode, the timing controller 222 according to the present disclosure may cause the analog processing unit 340 to supply the data signal of the black image to some of the pixels in the second region 320 and may cause the gamma voltage generator 350 to supply the data signal of the black image to the remaining pixels in the second region 320.

In the present disclosure, a reason why the timing controller 222 uses the analog processing unit 340 and the gamma voltage generator 350 so as to supply the data signal of the black image to the pixels included in the second region 320 is to reduce a color difference between a black displayed in the first region 310 and a black displayed in the second region 320. Specifically, when the transistors of each pixel P are turned off by supplying a low potential driving voltage to the pixels P included in the display panel 210 to display the black image in the second region 320, a color difference is inevitably occurred between the black displayed in the first region 310 and the black displayed in the second region 320. However, when the data signal of the black image is supplied to the pixels included in the second region 320 using the analog processing unit 340 and the gamma voltage generator 350 as in the present disclosure, the color difference between the blacks displayed in the first region 310 and the second region 320 does not occur.

According to the above-described embodiment, the timing controller 222 according to the present disclosure may set one horizontal line among a plurality of horizontal lines HL2_1 to HL2_*m* constituting the second region 320 as a precharge horizontal line PC_HL, may cause the data signal of the black image to be supplied from the analog processing unit 340 to the pixels included in the precharge horizontal lines PC_HL, and may cause the data signal of the black image to be supplied from the gamma voltage generator 350 to the pixels included in other horizontal lines HL2_1 to HL2_*i* and HL2_*j* to HL2_*m* excluding the precharge horizontal line PC_HL.

In an embodiment, the precharge horizontal line PC_HL may be set as a horizontal line adjacent to a last horizontal line HL1_*n* among horizontal lines HL1_1 to HL1_*n* constituting the first region 310. In this case, when the last horizontal line HL1_*n* constituting the first region 310 is driven, the analog processing unit 340 supplies the data signal of the standby image to each of the data lines DL, and continuously, when the precharge horizontal line PC_HL is driven, the analog processing unit 340 supplies the data signal of the black image to each of the data lines DL so that each of the data lines DL is precharged with the data signal of the black image by the analog processing unit 340.

As described above, in the present disclosure, a reason why, the timing controller 222 precharges each of the data lines DL with the data signal of the black image supplied from the analog processing unit 340 when the precharge horizontal line PC_HL is driven, and the timing controller 222 causes the data signal of the black image to be supplied from the gamma voltage generator 350 to each of the data lines DL when the other horizontal lines HL2_*j* to HL2_*m* disposed after the precharge horizontal line PC_HL are driven is as follows.

When all the horizontal lines HL2_1 to HL2_*m* constituting the second region 320 are driven, if the analog processing unit 340 supplies the data signal of the black image to each data line DL, the analog processing unit 340 has no choice but to operate continuously to supply the data signal of the black image even in the low power mode, and thus the power consumption increases. In addition, when all the horizontal lines HL2_1 to HL2_*m* constituting the second region 320 are driven, if the gamma voltage generator 350 supplies the data signal of the black image to each data line DL, one gamma voltage generator 350 should bear the entire load of the display panel 210, and thus a settling time required by the display panel 210 may not be satisfied.

Accordingly, in the present disclosure, when the other horizontal lines HL2_1 to HL2_*i* and HL2_*j* to HL2_*m* excluding the precharge horizontal line PC_HL in the second region 320 are driven, the gamma voltage generator 350 supplies the data signal of the black image to each data line DL, and thus an operation of the analog processing unit 340 may be stopped during the corresponding period, thereby minimizing power consumption. In addition, when the precharge horizontal line PC_HL is driven, since the analog processing unit 340 supplies the data signal of the black image to each data line DL, each of the data lines DL can be precharged with the data signal of the black image in advance, thereby reducing a panel load that the gamma voltage generator 350 should bear, and accordingly, the settling time may be satisfied.

In the above-described embodiment, the timing controller 222 according to the present disclosure may generate a first switching unit enable signal SW_EN turning the plurality of first switching units 360 on and off to selectively connect one of the analog processing unit 340 and the gamma voltage generator 350 to each data line DL in the low power mode.

Figure 3B:
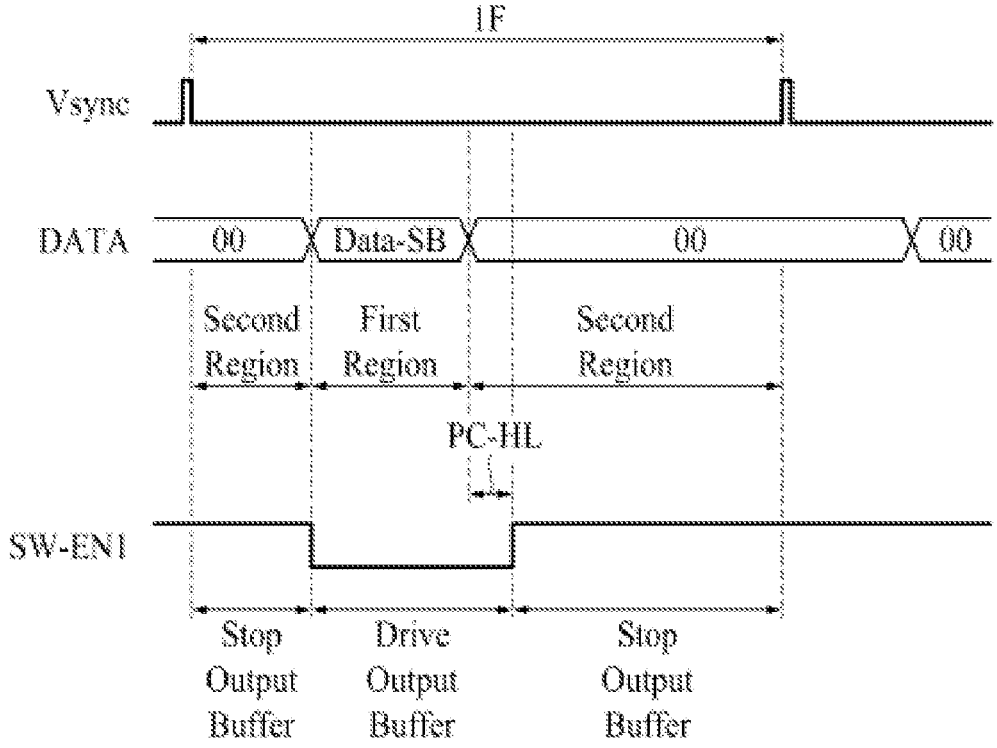
FIG. 3B is a diagram illustrating an operation timing of the display driving device shown in FIG. 3A.

Specifically, as shown in FIG. 3B, when the precharge horizontal line PC_HL included in the second region 320, and the first region 310 are driven in the low power mode, the timing controller 222 generates a first switching unit enable signal SW_EN1 of a first logic level (Low), and when the other horizontal lines HL2_1 to HL2_*i* and HL2_*j* to HL2_*m* excluding the precharge horizontal line PC_HL in the second region 320 are driven, the timing controller 222 generates the first switching unit enable signal SW_EN1 of a second logic level (High).

The timing controller 222 transmits the generated first switching unit enable signal SW_EN1 to the plurality of first switching units 360 and the analog processing unit 340.

Figure 4A:
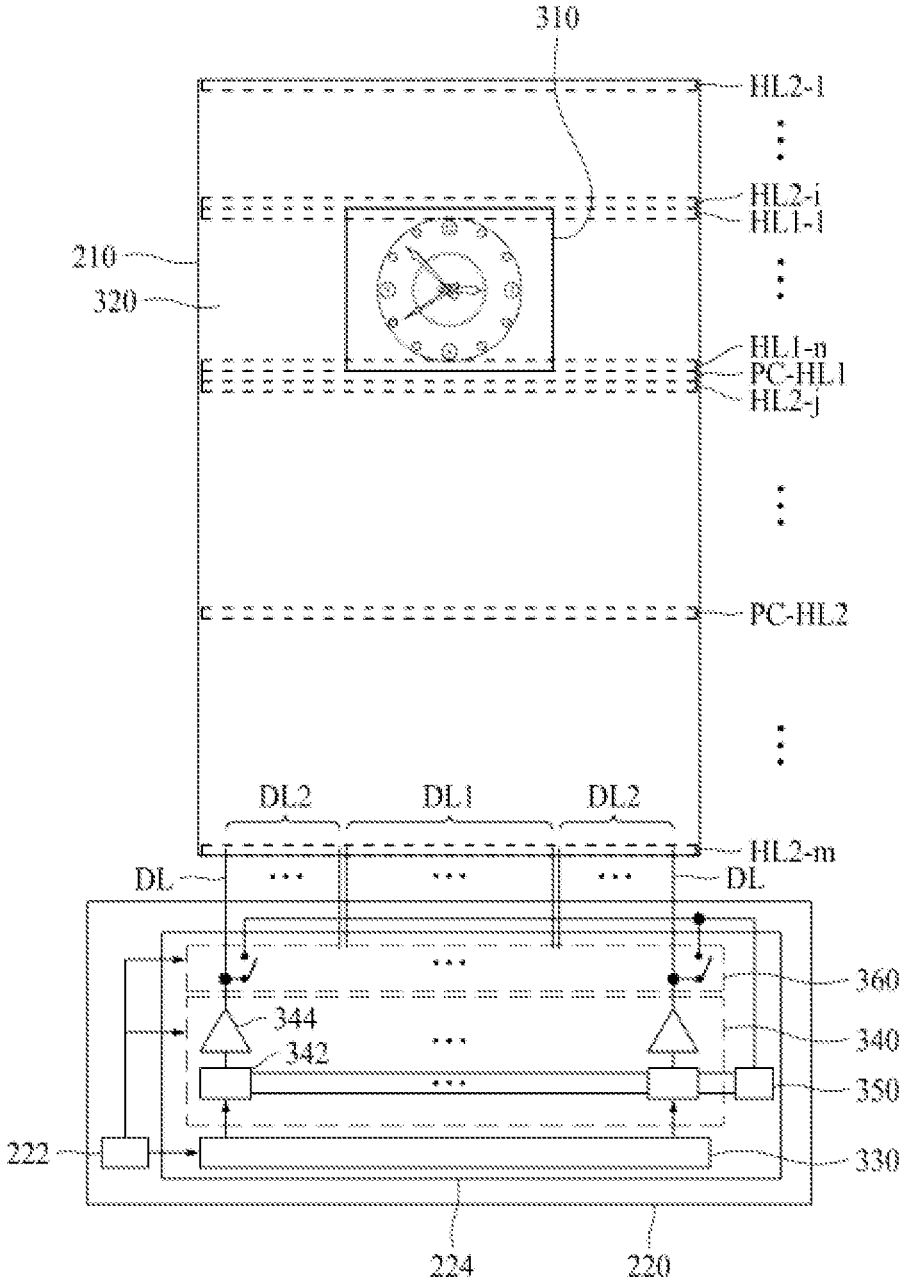
FIG. 4A is a diagram illustrating a specific configuration of a display driving device according to another embodiment of the present disclosure.

In the above-described embodiment, it is described that the timing controller 222 sets one horizontal line among the plurality of horizontal lines HL2_1 to HL2_*m* constituting the second region 320 within one frame 1F as the precharge horizontal line PC_HL. However, in another embodiment, the timing controller 222 may set a plurality of precharge horizontal lines PC_HL1 and PC_HL2 among the plurality of horizontal lines HL2_1 to HL2_*m* constituting the second region 320 within one frame 1F as shown in FIG. 4A according to an amount of leakage current. FIG. 4A illustrates that the timing controller 222 sets two precharge horizontal lines PC_HL1 and PC_HL2 for convenience of description, but this is only an example, and the timing controller 222 may also set three or more precharge horizontal lines.

According to this embodiment, a first precharge horizontal line PC_HL1 may be set as a horizontal line adjacent to the last horizontal line HL1_*n* among the horizontal lines HL1_1 to HL1_*n* constituting the first region 310, and a second precharge horizontal line PC_HL2 may be set as a horizontal line spaced apart by a plurality of horizontal lines from the first precharge horizontal line PC_HL1.

Figure 4B:
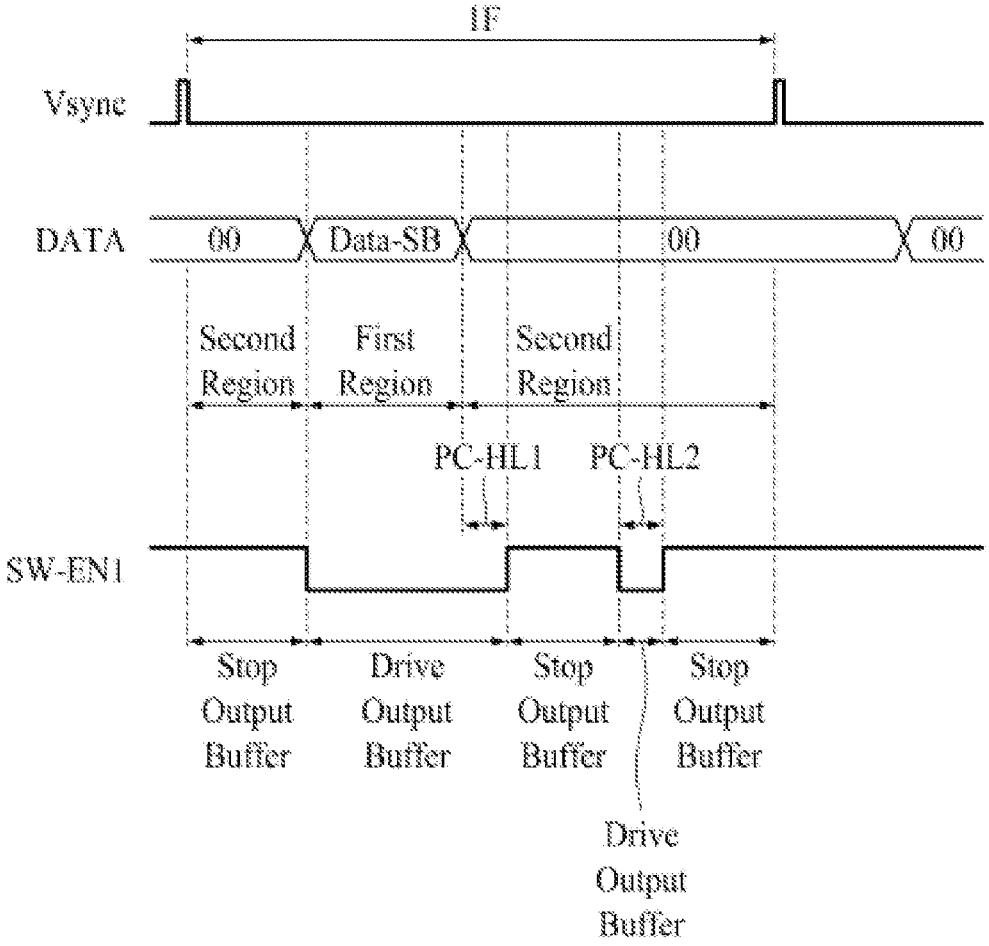
FIG. 4B is a diagram illustrating an operation timing of the display driving device shown in FIG. 4A.

In this case, as shown in FIG. 4B, when the first precharge horizontal line PC_HL1 and the second precharge horizontal line PC_HL2 that are included in the second region 320, and the first region 310 are driven in the low power mode, the timing controller 222 generates the first switching unit enable signal SW_EN1 of the first logic level, and when the other horizontal lines HL2_1 to HL2_*i* and HL2_*j* to HL2_*m* excluding the first precharge horizontal line PC_HL1 and the second precharge horizontal line PC_HL2 in the second region 320 are driven, the timing controller 222 generates the first switching unit enable signal SW_EN1 of the second logic level.

Meanwhile, the timing controller 222 receives timing signals from the host system to display the normal image or the standby image and generates a data timing control signal for controlling an operation timing of the data driver 224 and a gate timing control signal for controlling an operation timing of the gate driver 230. In an embodiment, the timing signals may include a vertical synchronization signal Vsync, a horizontal synchronization signal Hsync, a dot clock CLK, a data enable signal DE, and the like. The timing controller 222 supplies the data timing control signal to the data driver 224 together with the first switching unit enable signal SW_EN1 and supplies the gate timing control signal to the gate driver 230.

In an embodiment, the data timing control signal may include a source start pulse (SSP), a source sampling clock (SSC), a source output enable signal, and the like, and the gate timing control signal may include a gate start pulse (GSP), a gate shift clock (GSC), a gate output enable signal, and the like.

Here, the source start pulse (SSP) is a signal for controlling a data sampling start timing of the digital processing unit 330 included in the data driver 224. The source sampling clock (SSC) is a clock signal for controlling a data sampling timing in the digital processing unit 330. The source output enable signal is a signal for controlling an output timing of the data signal.

The gate start pulse (GSP) is a signal for controlling an operation start timing of the gate driver 230. The gate shift clock (GSC) is a clock signal input to the gate driver 230 and is a signal for controlling a shift timing of a gate pulse. The gate output enable signal designates timing information of the gate driver 230.

The data driver 224 generates the data signal for the normal image, the data signal for the standby image, or the data signal for the black image according to the data timing control signal and the first switching unit enable signal SW_EN1 input from the timing controller 222 to supply the data signal to each pixel P of the display panel 210 through the data line DL.

Specifically, the digital processing unit 330 included in the data driver 224 latches the normal image in the normal mode, or the standby image or the black image in the low power mode to supply the image to the analog processing unit 340. To this end, the digital processing unit 330 may include a shift register (not shown) that sequentially generates a sampling clock by shifting the source start pulse (SSP) according to the source shift clock (SSC), and a latch (not shown) that sequentially latches the normal image, the standby image, or the black image according to the sampling clock.

The analog processing unit 340 included in the data driver 224 converts the normal image, the standby image, or the black image output from the digital processing unit 330 into the data signal of analog format using gamma voltages supplied from the gamma voltage generator 350 and outputs the converted data signal to each of the data lines DL.

To this end, the analog processing unit 340 may include a digital-to-analog converter 342 converting the normal image, the standby image, or the black image to be supplied for each data line DL into the data signal of analog format and a plurality of output buffers 344 outputting the data signal to each data line DL.

According to this embodiment, when operating in the normal mode, each of the output buffers 344 supplies the data signal of the normal image to each data line DL, and when operating in the low power mode, as shown in FIG. 3B, when the horizontal lines HL1 to HLn included in the first region 310 are driven, each of the output buffers 344 supplies the data signal Data_SB of the standby image to each of the data lines DL, and when the precharge horizontal line PC_HL included in the second region 320 is driven, each of the output buffers 344 supplies the data signal 00 of the black image to each of the data lines DL.

Meanwhile, when operating in the low power mode, as shown in FIG. 3B, when the other horizontal lines HL2_1 to HL2_*i* and HL2_*j* to HL2_*m* excluding the precharge horizontal line PC_HL in the second region 320 are driven, each of the output buffers 344 switches output channels to a high-impedance state according to the first switching unit enable signal SW_EN1 transmitted from the timing controller 222. Accordingly, each of the output buffers 344 stops an operation without being connected to the data lines DL, thereby minimizing power consumption.

In the above-described embodiment, it is described that each of the output buffers 344 is connected to the data line DL or converted to the high-impedance state according to the first switching unit enable signal SW_EN1 input from the timing controller 222. However, in another embodiment, states of each of the output buffers 344 may be controlled according to a separate output buffer enable signal for controlling the states of the output buffers 344.

In this case, the timing controller 222 may generate the output buffer enable signal for controlling the states of the output buffers 344 to transmit the output buffer enable signal to each of the output buffers 344. In an embodiment, the timing controller 222 may generate the output buffer enable signal by inverting the first switching unit enable signal SW_EN1. That is, when the first switching unit enable signal SW_EN1 transitions from the second logic level to the first logic level, the output buffer enable signal transitions from the first logic level to the second logic level, and when the first switching unit enable signal SW_EN1 transitions from the first logic level to the second logic level, the output buffer enable signal transitions from the second logic level to the first logic level.

The gamma voltage generator 350 generates a plurality of gradation voltages (e.g., V0 to V255) using a resistor string for outputting the normal image or the standby image when operating in the normal mode or the low power mode and supplies the generated plurality of gradation voltages to the analog processing unit 340.

In particular, when operating in the low power mode, as shown in FIG. 3B, when the other horizontal lines HL2_1 to HL2_*i*, HL2_*j* to HL2_*m* excluding the precharge horizontal line PC_HL included in the second region 320 are driven, the gamma voltage generator 350 according to the present disclosure is connected to each of the data lines DL through the first switching unit 360 to supply the data signal 00 of the black image to each data line DL.

Meanwhile, as shown in FIG. 3B, when operating in the low power mode, the gamma voltage generator 350 is separated from each of the data lines DL when the precharge horizontal line PC_HL and the horizontal lines HL1 to HLn included in the first region 310 are driven.

In the above-described embodiment, it is described that when the analog processing unit 340 operates in the low power mode, the analog processing unit 340 supplies the data signal of the black image to not only first data lines DL_1 connected to first pixels adjacent to the first region 310 among pixels of the precharge horizontal line PC_HL but also second data lines DL_2 connected to second pixels excluding the first pixels adjacent to the first region 310 when the precharge horizontal line PC_HL is driven. This is because when the precharge horizontal line PC_HL is driven, the analog processing unit 340 also supplies the data signal of the black image to the second data lines DL_2 so that the second data lines DL_2 may also be precharged on a frame-by-frame basis, thereby preventing discharge due to leakage current.

Therefore, when the amount of leakage current is not large, when the precharge horizontal line PC_HL is driven, the analog processing unit 340 supplies the data signal of the black image only to the first data lines DL_1, and the gamma voltage generator 350 may supply the data signal of the black image to the second data lines DL_2.

Referring again to FIG. 3A, the plurality of first switching units 360 are turned on and off according to the first switching unit enable signal SW_EN1 input from the timing controller 222 to selectively connect the gamma voltage generator 350 to each of the data lines DL. Specifically, as shown in FIG. 3B, when the first switching unit enable signal SW_EN1 of the first logic level is input, the first switching units 360 are turned off so that the gamma voltage generator 350 is separated from each of the data lines DL. In addition, when the first switching unit enable signal SW_EN1 of the second logic level is input, the first switching units 360 are turned on so that the gamma voltage generator 350 is connected to each of the data lines DL.

Meanwhile, in FIG. 3A, it is described that the plurality of first switching units 360 are turned on and off according to the first switching unit enable signal SW_EN1 input from the timing controller 222 to selectively connect the gamma voltage generator 350 to each of the data lines DL, and when the gamma voltage generator 350 is connected to the data line DL, the output buffers 344 are controlled in the high-impedance state.

Figure 5:
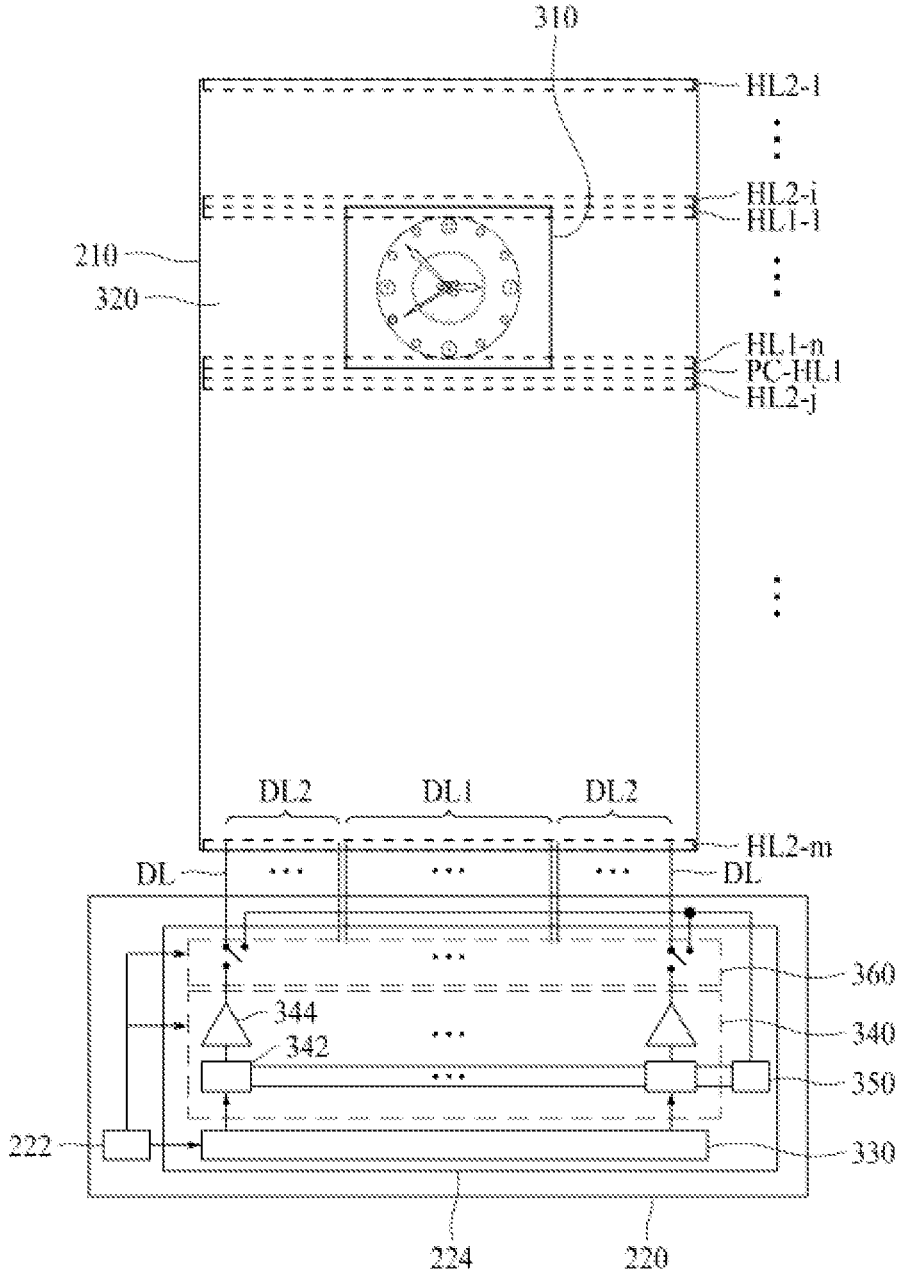
FIG. 5 is a diagram illustrating a specific configuration of a display driving device according to still another embodiment of the present disclosure.

However, in another embodiment, as shown in FIG. 5, the plurality of first switching units 360 may selectively connect one of the gamma voltage generator 350 and the output buffers 344 to the data line DL according to the first switching unit enable signal SW_EN1 input from the timing controller 222. That is, when the first switching unit enable signal SW_EN1 of the first logic level is input, the first switching unit 360 may connect the output buffers 344 to each data line DL and may separate the gamma voltage generator 350 from the data line DL, and when the first switching unit enable signal SW_EN1 of the second logic level is input, the first switching unit 360 may connect the gamma voltage generator 350 to each data line DL and may separate the output buffers 344 from each data line DL.

Figure 6A:
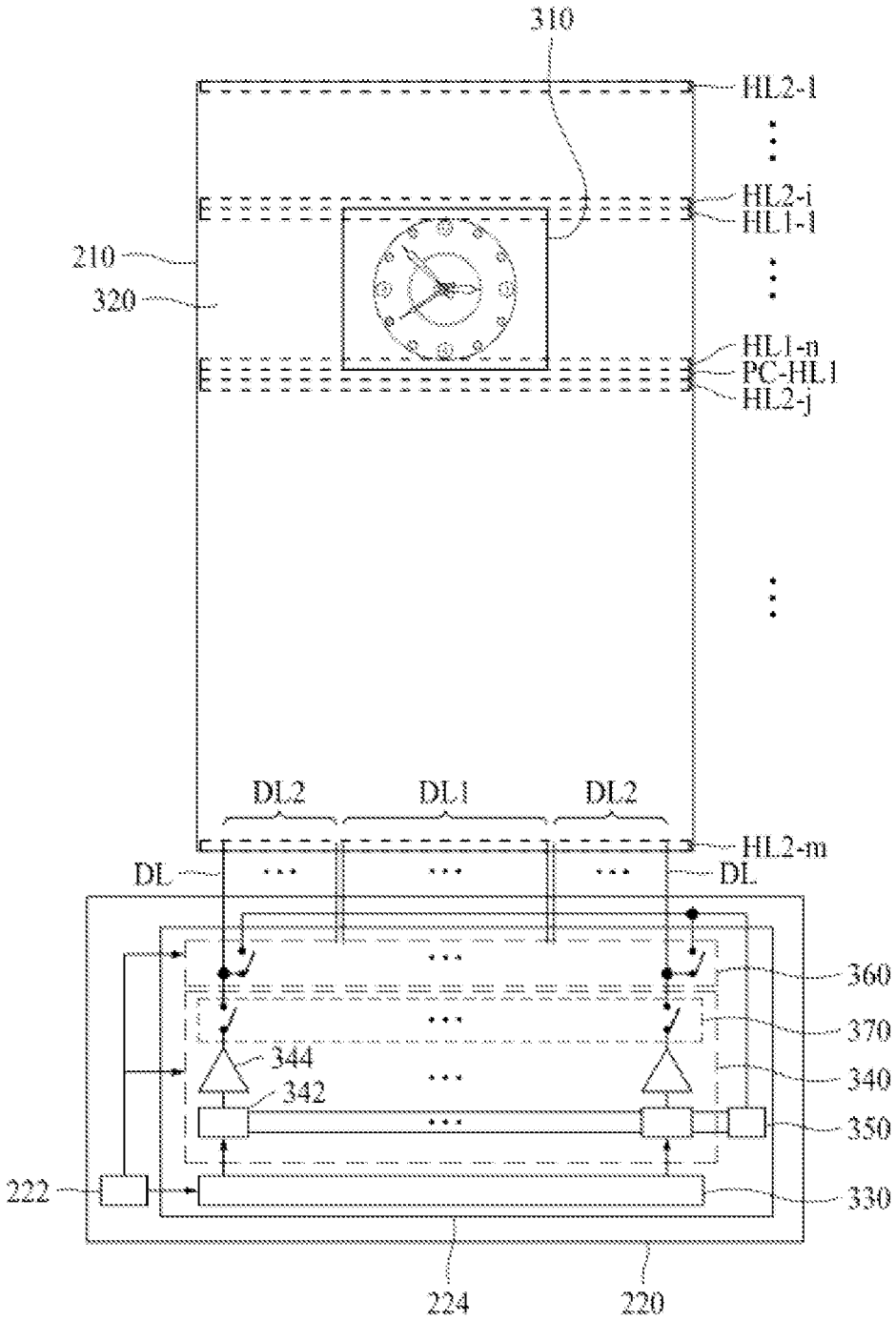
FIG. 6A is a diagram illustrating a specific configuration of a display driving device according to yet another embodiment of the present disclosure.

As still another example, as shown in FIG. 6A, the data driver 224 may further include a plurality of second switching units 370 selectively connecting each of the output buffers 344 to each data line DL in addition to the first switching unit 360 selectively connecting the gamma voltage generator 350 to each data line DL.

Figure 6B:
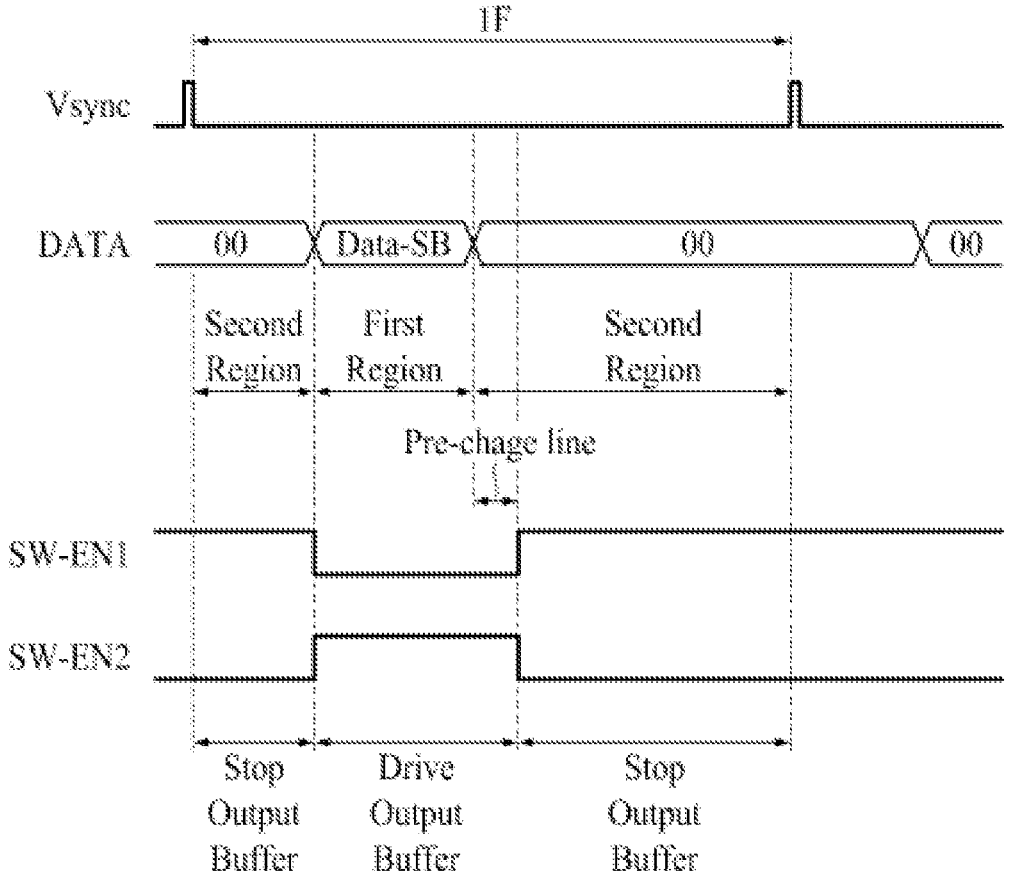
FIG. 6B is a diagram illustrating an operation timing of the display driving device shown in FIG. 6A.

According to this embodiment, the first switching unit 360 and the second switching unit 370 operate complementarily, and as shown in FIG. 6B, the timing controller 222 may additionally generate a second switching unit enable signal SW_EN2 for controlling the second switching unit 370.

Specifically, when operating in the low power mode, when the first precharge horizontal line PC_HL included in the second region 320, and the first region 310 are driven, the timing controller 222 generates the first switching unit enable signal SW_EN1 of the first logic level (Low) to supply the first switching unit enable signal SW_EN1 to the first switching unit 360 and generates the second switching unit enable signal SW_EN2 of the second logic level (High) to supply the second switching unit enable signal SW_EN2 to the second switching unit 370.

Accordingly, the first switching unit 360 is turned off to separate the gamma voltage generator 350 from the data line DL, and the second switching unit 370 is turned on to connect the output buffers 344 to each data line DL.

In addition, when operating in the low power mode, when the other horizontal lines HL2_1 to HL2_*i* and HL2_*j* to HL2_*m* excluding the precharge horizontal line PC_HL in the second region 320 are driven, the timing controller 222 generates the first switching unit enable signal SW_EN1 of the second logic level (High) to supply the first switching unit enable signal SW_EN1 to the first switching unit 360 and generates the second switching unit enable signal SW_EN2 of the first logic level (Low) to supply the second switching unit enable signal SW_EN2 to the second switching unit 370.

Accordingly, the first switching unit 360 is turned on to connect the gamma voltage generator 350 to the data line DL, and the second switching unit 370 is turned off to separate the output buffers 344 from each data line DL.

The display system 200 according to an embodiment of the present disclosure as described above may be provided in a mobile terminal (not shown). In an embodiment, the mobile terminal may include a mobile phone, a smart phone, a tablet computer, a wearable device, or the like. In another embodiment, the display system 200 may be provided in a device such as a television (TV) or a monitor.

Hereinafter, a display driving method supporting a low power mode according to the present disclosure will be described.

Figure 7:
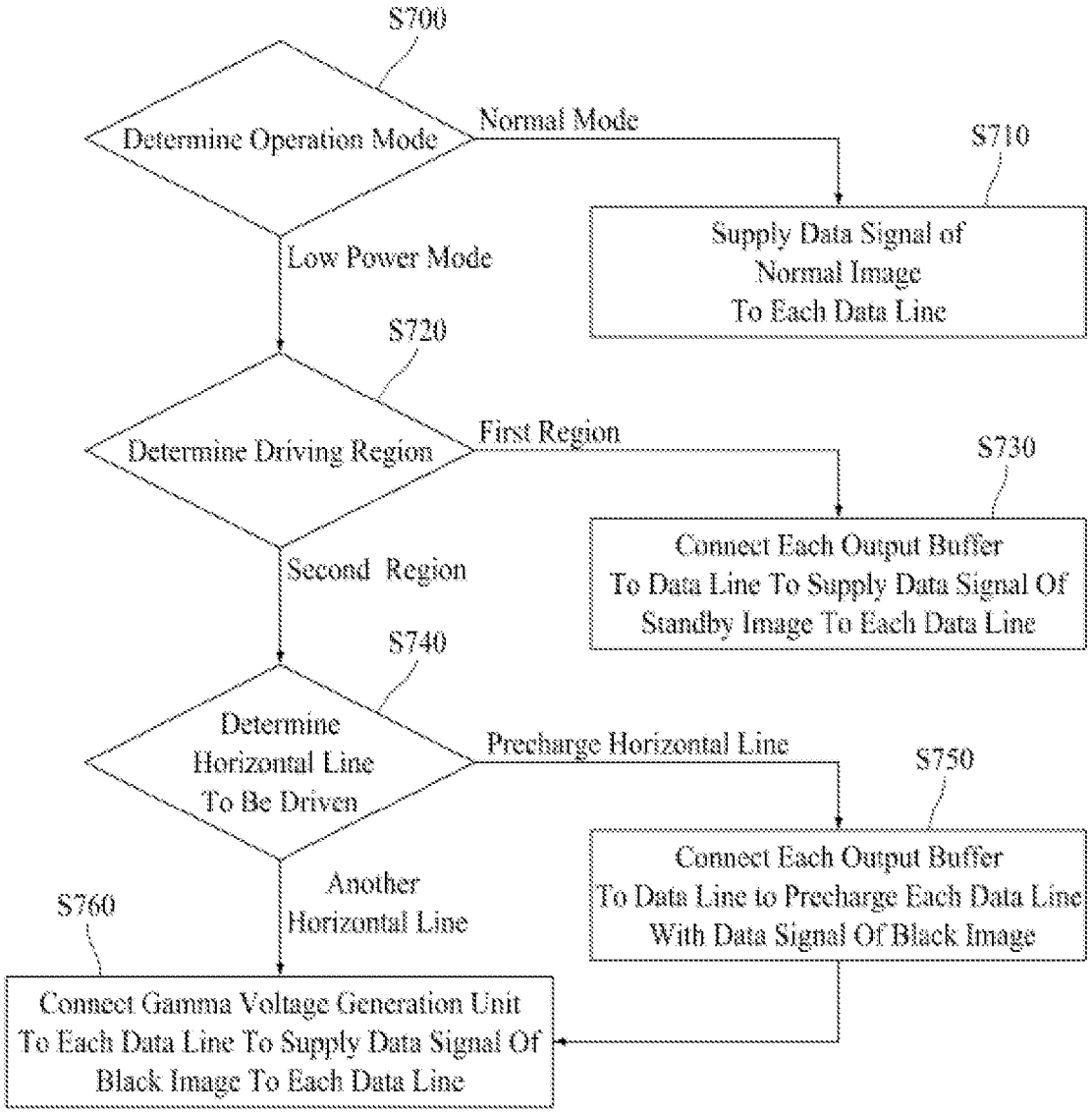
FIG. 7 is a flowchart illustrating a display driving method supporting a low power mode according to an embodiment of the present disclosure.

FIG. 7 is a flowchart illustrating a display driving method supporting a low power mode according to an embodiment of the present disclosure. The display driving method supporting a low power mode shown in FIG. 7 (hereinafter, referred to as "display driving method") may be performed by the display driving device shown in FIG. 3A.

The display driving device determines an operation mode of a display system (S700). In an embodiment, the operation mode of the display system may include a normal mode in which a normal image is displayed in a first region and a second region of a display panel, and a low power mode in which a standby image is displayed in the first region of the display panel and a black image is displayed in the second region of the display panel. In this case, the standby image may include a clock image, a calendar image, a weather image, and the like, or may include an image preset by a user.

In the above-described embodiment, when the mobile terminal to which the display system is applied is in an active state, the display driving device may determine the operation mode of the display system as the normal mode, and when the mobile terminal is in an inactive state, the display driving device may determine the operation mode of the display system as the low power mode.

When the operation mode of the display system is determined as the normal mode, the display driving device supplies a data signal of a normal image input from a host system to each data line of the display panel (S710).

Meanwhile, when the operation mode of the display system is determined as the low power mode, the display driving device determines whether a region of the display panel to be driven is the first region where the standby image is to be displayed or the second region where the black image is to be displayed (S720).

When the region to be driven is the first region, the display driving device connects each output buffer to the data line so that each of the output buffers supplies a data signal of the standby image to each data line (S730).

Meanwhile, when it is determined that the region to be driven is the second region as a result of the determination in S720, the display driving device determines whether a horizontal line to be driven is a precharge horizontal line (S740).

When it is determined that the horizontal line to be driven is the precharge horizontal line as a result of the determination, the display driving device connects each output buffer to the data line so that each output buffer precharges each data line with a data signal of the black image (S750).

In an embodiment, the precharge horizontal line may be set as a horizontal line adjacent to a last horizontal line among horizontal lines constituting the first region. In this case, when the last horizontal line constituting the first region is driven, the output buffer supplies the data signal of the standby image to each data line, and continuously, when the precharge horizontal line is driven, the output buffer supplies the data signal of the black image to each data line so that each data line is precharged with the data signal of the black image by the output buffer.

Meanwhile, when it is determined that the horizontal line to be driven is a horizontal line other than the precharge horizontal line as a result of the determination of S740, or the precharge of the data line through S750 is completed, the display driving device connects a gamma voltage generator to each data line through a first switching unit so that the gamma voltage generator supplies the data signal of the black image to each data line (S760). In this case, the output buffers are controlled in a high-impedance state and separated from the data line, and the operation is stopped.

As described above, in the present disclosure, a reason why, after precharging each data line with the data signal of the black image supplied from the output buffers when the precharge horizontal line is driven, the display driving device causes the data signal of the black image to be supplied from the gamma voltage generator to each data line is as follows.

When all the horizontal lines constituting the second region are driven, if the output buffers supply the data signal of the black image to each data line, the output buffers have no choice but to operate continuously to supply the data signal of the black image even in the low power mode, and thus the power consumption increases, and when all the horizontal lines constituting the second region are driven, if the gamma voltage generator supplies the data signal of the black image to each data line, one gamma voltage generator should bear the entire load of the display panel, and thus the settling time required by the display panel may not be satisfied.

Accordingly, in the present disclosure, when the precharge horizontal line included in the second region is driven, the output buffer precharges the data line with the data signal of the black image, and then, when the other horizontal lines included in the second region are driven, the gamma voltage generator supplies the data signal of the black image to the data line so that the panel load that the gamma voltage generator should bear may be reduced to satisfy the settling time, and the operation of the output buffer may be stopped during a period after the precharge of the precharge horizontal line is completed, thereby minimizing the power consumption.

In the above-described embodiment, it is described that there is one precharge horizontal line, but a plurality of precharge horizontal lines may be set according to the amount of leakage current. According to this embodiment, the first precharge horizontal line may be set as a horizontal line adjacent to the last horizontal line among the horizontal lines constituting the first region, and the second precharge horizontal line may be set as a horizontal line spaced apart by a plurality of horizontal lines from the first precharge horizontal line.

In addition, in the above-described embodiment, it is described that when the output buffer operates in the low power mode, the output buffer supplies the data signal of the black image to not only first data lines connected to first pixels adjacent to the first region among pixels of the precharge horizontal line but also second data lines connected to second pixels excluding the first pixels adjacent to the first region when the precharge horizontal line is driven. This is because when the precharge horizontal line is driven, the output buffer also supplies the data signal of the black image to the second data lines so that the second data lines may also be precharged on a frame-by-frame basis, thereby preventing discharge due to leakage current.

Therefore, when the amount of leakage current is not large, the output buffer supplies the data signal of the black image only to the first data lines, and the gamma voltage generator may supply the data signal of the black image to the second data lines when the precharge horizontal line is driven.

According to the present disclosure, a gamma voltage generator may supply a voltage corresponding to a black gradation to each source channel to display a black image in a first panel region where the black image is displayed when driving in a low power mode, and thus there is an effect that the drive of an output buffer of each of the source channels can be stopped and power consumption can be reduced.

In addition, according to the present disclosure, the voltage corresponding to the black gradation generated by the gamma voltage generator in the first panel region is supplied to each source channel when driving in the low power mode, and thus there is an effect that a color difference between the black image displayed in the second panel region and the black image displayed in the first panel region can be reduced.

In addition, according to the present disclosure, data lines connected to pixels included in a precharge horizontal line among horizontal lines included in the first panel region are precharged with the voltage corresponding to the black gradation output from the output buffer, and thus the increase in panel load is minimized even though the gamma voltage generator supplies the voltage corresponding to the black gradation to each of the data lines when a normal horizontal line adjacent to the precharge horizontal line is driven, and accordingly, there is an effect that the settling time can be satisfied and the deterioration of the image quality can be prevented.

Further, according to the present disclosure, each of the data lines may be precharged in units of the precharge horizontal lines by setting a plurality of precharge horizontal lines, and thus it is possible to minimize the leak current occurred by the gamma voltage generator continuously supplying the voltage corresponding to the black gradation in the first panel region, and accordingly, there is an effect that the increase in power consumption can be suppressed.

Furthermore, according to the present disclosure, the data lines connected to the pixels not adjacent to the pixels included in the second panel region among the pixels included in the precharge horizon line may also be precharged by the output buffer, and thus there is an effect that the prevention of leakage current generation can be maximized.

It should be understood by those skilled in the art that the present disclosure can be embodied in other specific forms without changing the technical concept and essential features of the present disclosure.

All disclosed methods and procedures described herein may be implemented, at least in part, using one or more computer programs or components. These components may be provided as a series of computer instructions through any conventional computer-readable medium or machine-readable medium including volatile and nonvolatile memories such as random-access memories (RAMs), read only-memories (ROMs), flash memories, magnetic or optical disks, optical memories, or other storage media. The instructions may be provided as software or firmware, and may, in whole or in part, be implemented in a hardware configuration such as application-specific integrated circuits (ASICs), field-programmable gate arrays (FPGAs), digital signal processors (DSPs), or any other similar device. The instructions may be configured to be executed by one or more processors or other hardware configurations, and the processors or other hardware configurations are allowed to perform all or part of the methods and procedures disclosed herein when executing the series of computer instructions.

Therefore, the above-described embodiments should be understood to be exemplary and not limiting in every aspect. The scope of the present disclosure will be defined by the following claims rather than the above-detailed description, and all changes and modifications derived from the meaning and the scope of the claims and equivalents thereof should be understood as being included in the scope of the present disclosure.

What is claimed is:

1. A display driving device supporting a low power mode, the display device comprising:

a plurality of output buffers connected to data lines to output a first data signal corresponding to a black image to the data lines when a precharge horizontal line is driven in a display panel including a first region where a standby image is displayed and a second region where the black image is displayed, the precharge horizontal line included in the second region; and a gamma voltage generator connected to the data lines to output the first data signal to the data lines when horizontal lines other than the precharge horizontal line in the second region are driven.

2. The display driving device of claim 1, wherein the precharge horizontal line includes a first precharge horizontal line adjacent to a last horizontal line included in the first region among the horizontal lines included in the second region.

3. The display driving device of claim 2, wherein the precharge horizontal line further includes at least one second precharge horizontal line spaced apart from the first precharge horizontal line by a predetermined number of horizontal lines.

4. The display driving device of claim 1, further comprising:

a plurality of first switching units configured to selectively connect the gamma voltage generator to the data lines; and a timing controller configured to generate a first switching unit enable signal for on-off control of the plurality of first switching units, wherein the plurality of first switching units are turned off to separate the gamma voltage generator from the data lines when the first switching unit enable signal of a first logic level is input from the timing controller, and the plurality of first switching units are turned on to connect the gamma voltage generator to the data lines when the first switching unit enable signal of a second logic level is input.

5. The display driving device of claim 4, wherein when the first switching unit enable signal of the second logic level is input from the timing controller, the plurality of output buffers are maintained in a high-impedance state and the drive is stopped, and when the first switching unit enable signal of the first logic level is input, the plurality of output buffers supply the first data signal to each of the data lines.

6. The display driving device of claim 1, further comprising:

a plurality of first switching units configured to selectively connect one of the gamma voltage generator and the plurality of output buffers to the data lines; and a timing controller configured to generate a first switching unit enable signal for controlling the plurality of first switching units, wherein the plurality of first switching units connect the plurality of output buffers to the data lines when the first switching unit enable signal of a first logic level is input from the timing controller, and the plurality of first switching units connect the gamma voltage generator to the data lines when the first switching unit enable signal of a second logic level is input.

7. The display driving device of claim 1, further comprising:

a plurality of first switching units configured to selectively connect the gamma voltage generator to the data lines;

a plurality of second switching units configured to selectively connect the plurality of output buffers to the data lines; and a timing controller configured to generate a second switching unit enable signal for controlling the plurality of first switching units and the plurality of second switching units, wherein the plurality of first and second switching units operate complementarily, and when the second switching unit enable signal of a first logic level is input from the timing controller, the plurality of first switching units are turned off and the plurality of second switching units are turned on to connect the plurality of output buffers to the data line, and when the second switching unit enable signal of a second logic level is input from the timing controller, the plurality of first switching units are turned on and the plurality of second switching units are turned off to connect the gamma voltage generator to the data lines.

8. The display driving device of claim 1, further comprising a timing controller configured to operate the display panel in one of a low power mode in which the standby image is displayed in the first region and the black image is displayed in the second region and a normal mode in which a normal image is displayed in the first and second regions.

9. The display driving device of claim 1, wherein when the first region is driven, the plurality of output buffers are connected to the data lines to output a second data signal of the standby image to the data lines, and the gamma voltage generator generates a gamma voltage corresponding to a plurality of gradations for representing the standby image to output the gamma voltage to the plurality of output buffers.

10. The display driving device of claim 1, wherein the precharge horizontal line is set as a horizontal line adjacent to a last horizontal line constituting the first region among the plurality of horizontal lines included in the second region, and when the precharge horizontal line is driven, the plurality of output buffers output the first data signal to first data lines connected to first pixels adjacent to the first region among pixels included in the precharge horizontal line.

11. The display driving device of claim 10, wherein when the precharge horizontal line is driven, the gamma voltage generator outputs the first data signal to second data lines connected to second pixels excluding the first pixels among the pixels included in the precharge horizon line.

12. A display driving method supporting a low power mode, the method comprising:

connecting a plurality of output buffers to data lines when driving a first region in which a standby image is displayed in a display panel and supplying a data signal of the standby image to each of the data lines;

connecting the plurality of output buffers to the data lines when driving a precharge horizontal line included in a second region where a black image is displayed and outputting a data signal corresponding to the black image to the data lines; and connecting a gamma voltage generator to the data lines when driving horizontal lines other than the precharge horizontal line in the second region and outputting the data signal corresponding to the black image to each of the data lines.

13. The display driving method of claim 12, wherein the precharge horizontal line includes a first precharge horizontal line adjacent to a last horizontal line included in the first region among the horizontal lines included in the second region.

14. The display driving method of claim 13, wherein the plurality of output buffers output the data signal corresponding to the black image to first data lines connected to first pixels adjacent to the first region among pixels included in the first precharge horizontal line when driving the precharge horizontal line.

15. The display driving method of claim 13, wherein the precharge horizontal line further includes at least one second precharge horizontal line spaced apart from the first precharge horizontal line by a predetermined number of horizontal lines.

16. The display driving method of claim 12, wherein the gamma voltage generator is separated from the data lines according to a first switching unit enable signal of a first logic level when driving the precharge horizontal line, and the gamma voltage generator is connected to the data lines according to the first switching unit enable signal of a second logic level, and the plurality of output buffers are maintained in a high-impedance state when driving horizontal lines other than the precharge horizontal line in the second region.

17. The display driving method of claim 12, wherein the plurality of output buffers are connected to the data lines according to a first switching unit enable signal of a first logic level when driving the precharge horizontal line, and the gamma voltage generator is connected to the data lines according to the first switching unit enable signal of a second logic level when driving horizontal lines other than the precharge horizontal line.

18. The display driving method of claim 12, wherein the gamma voltage generator is separated from the data lines according to a first switching unit enable signal of a first logic level and the plurality of output buffers are connected to the data lines according to a second switching unit enable signal of a second logic level when driving the precharge horizontal line, and the gamma voltage generator is connected to the data lines according to the first switching unit enable signal of a second logic level and the plurality of output buffers are separated from the data lines according to the second switching unit enable signal of a first logic level when driving horizontal lines other than the precharge horizontal line in the second region.

* * * * *